US010260360B2

(12) United States Patent
Flanagan et al.

(10) Patent No.: US 10,260,360 B2
(45) Date of Patent: Apr. 16, 2019

(54) TRANSITION DUCT ASSEMBLY

(71) Applicant: General Electric Company, Schenectady, NY (US)

(72) Inventors: James Scott Flanagan, Simpsonville, SC (US); Kevin Weston McMahan, Greer, SC (US); Jeffrey Scott LeBegue, Greer, SC (US)

(73) Assignee: General Electric Company, Schenectady, NY (US)

( * ) Notice: Subject to any disclaimer, the term of this patent is extended or adjusted under 35 U.S.C. 154(b) by 380 days.

(21) Appl. No.: 15/079,101

(22) Filed: Mar. 24, 2016

(65) Prior Publication Data

US 2017/0276002 A1 Sep. 28, 2017

(51) Int. Cl.
*F01D 9/02* (2006.01)
*F01D 25/28* (2006.01)

(52) U.S. Cl.
CPC ..... *F01D 9/023* (2013.01); *F01D 25/28* (2013.01); *F05D 2220/32* (2013.01); *F05D 2260/30* (2013.01)

(58) Field of Classification Search
CPC ..... F01D 9/023; F01D 25/246; F01D 25/28; F23R 3/46; F23R 2900/00012;
(Continued)

(56) References Cited

U.S. PATENT DOCUMENTS 4,422,288 A 12/1983 Steber
5,077,967 A 1/1992 Widener et al.
(Continued)

FOREIGN PATENT DOCUMENTS

DE 10 2012 112 867 A1 6/2014
EP 1722069 A1 11/2006
(Continued)

OTHER PUBLICATIONS

ElectroImpact (Inch Standard Counterbore, Jun. 2, 2005) accessed from https://www.electroimpact.com/Company/Standards/QMS-0003.pdf.*
(Continued)

*Primary Examiner* — Igor Kershteyn
*Assistant Examiner* — Topaz L. Elliott
(74) *Attorney, Agent, or Firm* — Charlotte C. Wilson; Ernest G. Cusick; Frank A. Landgraff

(57) ABSTRACT

A turbomachine includes a plurality of transition ducts and a support ring assembly. The outlet of a transition duct includes an inner flange and an outer flange. The turbomachine includes bore holes defined in the inner flange and outer flange, mating bore holes defined in the support ring assembly, and mechanical fasteners connecting the inner flange and the outer flange to the support ring assembly. A first one of the bore holes or mating bore holes has a first maximum radial gap and a first maximum tangential gap relative to an associated mechanical fastener. A second one of the bore holes or mating bore holes has a second maximum radial gap and a second maximum tangential gap relative to an associated mechanical fastener. The second maximum radial gap is greater than the first maximum radial gap or the second maximum tangential gap is greater than the first maximum tangential gap.

17 Claims, 11 Drawing Sheets

(58) Field of Classification Search
CPC ..... F05D 2260/30; F05D 2230/642; F05D 2240/35; F02C 7/28
USPC ..... 60/752
See application file for complete search history.

(56) References Cited

U.S. PATENT DOCUMENTS

| | | | | |
|---|---|---|---|---|
| 5,118,120 | A | 6/1992 | Drerup et al. | |
| 5,249,920 | A | 10/1993 | Shepherd et al. | |
| 5,414,999 | A | 5/1995 | Barnes | |
| 5,457,954 | A | 10/1995 | Boyd et al. | |
| 5,592,820 | A | 1/1997 | Alary et al. | |
| 5,761,898 | A * | 6/1998 | Barnes | F01D 9/023 60/39.37 |
| 5,839,283 | A | 11/1998 | Dübbeling | |
| 5,934,687 | A | 8/1999 | Bagepalli et al. | |
| 6,148,604 | A * | 11/2000 | Salt | F01D 9/023 60/39.37 |
| 6,202,420 | B1 | 3/2001 | Zarzalis et al. | |
| 6,203,025 | B1 | 3/2001 | Hayton | |
| 6,394,537 | B1 * | 5/2002 | DeRees | B62D 29/048 296/191 |
| 6,442,946 | B1 | 9/2002 | Kraft et al. | |
| 6,471,475 | B1 | 10/2002 | Sasu et al. | |
| 6,537,023 | B1 | 3/2003 | Aksit et al. | |
| 6,564,555 | B2 | 5/2003 | Rice et al. | |
| 6,640,547 | B2 | 11/2003 | Leahy, Jr. | |
| 6,652,229 | B2 | 11/2003 | Lu | |
| 6,662,567 | B1 * | 12/2003 | Jorgensen | F01D 9/023 60/796 |
| 7,007,480 | B2 | 3/2006 | Nguyen et al. | |
| 7,024,863 | B2 | 4/2006 | Morenko | |
| 7,181,914 | B2 | 2/2007 | Pidcock et al. | |
| 7,584,620 | B2 | 9/2009 | Weaver et al. | |
| 7,603,863 | B2 | 10/2009 | Widener et al. | |
| 7,614,236 | B2 * | 11/2009 | Mandet | F01D 25/24 60/766 |
| 7,637,110 | B2 | 12/2009 | Czachor et al. | |
| 7,721,547 | B2 | 5/2010 | Bancalari et al. | |
| 7,722,317 | B2 * | 5/2010 | Schiavo | F01D 25/246 266/285 |
| 7,836,677 | B2 | 11/2010 | Bland | |
| 7,958,734 | B2 * | 6/2011 | Paprotna | F01D 11/005 60/39.37 |
| 8,065,881 | B2 | 11/2011 | Charron et al. | |
| 8,091,365 | B2 | 1/2012 | Charron | |
| 8,113,003 | B2 | 2/2012 | Charron et al. | |
| 8,230,688 | B2 * | 7/2012 | Wilson | F23R 3/425 60/39.37 |
| 8,276,389 | B2 | 10/2012 | Charron et al. | |
| 8,616,007 | B2 | 12/2013 | Charron | |
| 8,667,682 | B2 | 3/2014 | Lee et al. | |
| 8,707,673 | B1 * | 4/2014 | Flanagan | F01D 9/023 60/39.37 |
| 8,745,986 | B2 | 6/2014 | Melton et al. | |
| 8,826,668 | B2 | 9/2014 | Lee et al. | |
| 8,915,706 | B2 | 12/2014 | Stein et al. | |
| 8,959,888 | B2 | 2/2015 | Laster et al. | |
| 8,961,118 | B2 | 2/2015 | Charron et al. | |
| 8,978,389 | B2 | 3/2015 | Wiebe | |
| 9,090,954 | B2 | 7/2015 | Tassios et al. | |
| 9,133,722 | B2 | 9/2015 | LeBegue et al. | |
| 9,322,334 | B2 * | 4/2016 | Casavant | F02C 7/20 |
| 9,593,853 | B2 * | 3/2017 | Montgomery | F23R 3/60 |
| 2009/0145137 | A1 | 6/2009 | Rizkalla et al. | |
| 2010/0037618 | A1 | 2/2010 | Charron et al. | |
| 2010/0037619 | A1 | 2/2010 | Charron | |
| 2010/0115953 | A1 | 5/2010 | Davis, Jr. et al. | |
| 2011/0056206 | A1 | 3/2011 | Wiege | |
| 2011/0067402 | A1 | 3/2011 | Wiebe et al. | |
| 2011/0259015 | A1 * | 10/2011 | Johns | F23R 3/425 60/772 |
| 2012/0031068 | A1 | 2/2012 | Charron | |
| 2012/0304653 | A1 | 12/2012 | Flanagan et al. | |
| 2012/0304665 | A1 | 12/2012 | LeBegue | |
| 2013/0061570 | A1 | 3/2013 | Charron et al. | |
| 2013/0081399 | A1 | 4/2013 | Wiebe | |
| 2013/0081407 | A1 | 4/2013 | Wiebe | |
| 2013/0139523 | A1 | 6/2013 | Myers et al. | |
| 2013/0174561 | A1 | 7/2013 | Stoia et al. | |
| 2013/0219853 | A1 | 8/2013 | Little et al. | |
| 2013/0219921 | A1 | 8/2013 | Wiebe et al. | |
| 2013/0224007 | A1 | 8/2013 | Rodriguez | |
| 2013/0224009 | A1 | 8/2013 | Little et al. | |
| 2013/0239585 | A1 | 9/2013 | Morrison | |
| 2014/0060000 | A1 | 3/2014 | Charron et al. | |
| 2014/0060001 | A1 | 3/2014 | Beeck | |
| 2014/0260317 | A1 | 9/2014 | Charron et al. | |
| 2014/0338304 | A1 | 11/2014 | Schilp | |
| 2015/0068211 | A1 | 3/2015 | Rodriguez | |
| 2015/0082794 | A1 | 3/2015 | Schilp | |
| 2015/0107264 | A1 | 4/2015 | Wiebe et al. | |
| 2015/0132117 | A1 | 5/2015 | Marra et al. | |
| 2015/0198054 | A1 | 7/2015 | Charron et al. | |
| 2015/0204243 | A1 | 7/2015 | Charron et al. | |

FOREIGN PATENT DOCUMENTS

| | | | | |
|---|---|---|---|---|
| JP | 2007224731 A * | 9/2007 | | F02C 7/28 |
| WO | WO 2017023325 A1 * | 2/2017 | | F01D 9/023 |
| WO | WO 2017074407 A1 * | 5/2017 | | F01D 5/28 |
| WO | WO-2017090221 A1 * | 6/2017 | | F02C 7/18 |

OTHER PUBLICATIONS

Extended European Search Report and Opinion issued in connection with corresponding EP Application No. 17161006.6 dated Aug. 2, 2017.
Hughes, et al.; U.S. Appl. No. 14/977,993, filed Dec. 22, 2015.
Hughes, et al.; U.S. Appl. No. 14/978,006, filed Dec. 22, 2015.
Hughes, et al.; U.S. Appl. No. 14/978,019, filed Dec. 22, 2015.

* cited by examiner

— PRIOR ART —

— PRIOR ART —

TRANSITION DUCT ASSEMBLY

FIELD OF THE DISCLOSURE

The subject matter disclosed herein relates generally to turbomachines, and more particularly to the use of transition ducts in turbomachines.

BACKGROUND OF THE DISCLOSURE

Turbomachines are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to power the compressor, an electrical generator, and other various loads.

The combustor sections of turbomachines generally include tubes or ducts for flowing the combusted hot gas therethrough to the turbine section or sections. Recently, combustor sections have been introduced which include tubes or ducts that shift the flow of the hot gas. For example, ducts for combustor sections have been introduced that, while flowing the hot gas longitudinally therethrough, additionally shift the flow radially and/or tangentially such that the flow has various angular components. These designs have various advantages, including eliminating first stage nozzles from the turbine sections. The first stage nozzles were previously provided to shift the hot gas flow, and may not be required due to the design of these ducts. The elimination of first stage nozzles may eliminate associated pressure drops and increase the efficiency and power output of the turbomachine.

However, the connection of these ducts to turbine sections is of increased concern. For example, because known ducts do not simply extend along a longitudinal axis, but are rather shifted off-axis from the inlet of the duct to the outlet of the duct, thermal expansion of the ducts can cause undesirable shifts in the ducts along or about various axes. These shifts can cause stresses and strains within the ducts, and may cause the ducts to fail.

Aspects and advantages of the disclosure will be set forth in part in the following description, or may be obvious from the description, or may be learned through practice of the disclosure.

In one embodiment, a turbomachine is provided. The turbomachine includes a plurality of transition ducts disposed in a generally annular array and including a first transition duct and a second transition duct. Each of the plurality of transition ducts includes an inlet, an outlet, and a passage defining an interior and extending between the inlet and the outlet and defining a longitudinal axis, a radial axis, and a tangential axis. The outlet of each of the plurality of transition ducts is offset from the inlet along the longitudinal axis and the tangential axis. The outlet of at least one transition duct of the plurality of transition ducts includes an inner flange and an outer flange. The turbomachine further includes a support ring assembly downstream of the plurality of transition ducts along a hot gas path, a plurality of bore holes defined in the inner flange and outer flange, and a plurality of mating bore holes defined in the support ring assembly. The turbomachine further includes a plurality of mechanical fasteners connecting the inner flange and the outer flange of the at least one transition duct to the support ring assembly, each of the plurality of mechanical fasteners extending through a bore hole and mating bore hole. A first one of the bore holes or mating bore holes has a first maximum radial gap and a first maximum tangential gap relative to the mechanical fastener extending through the first one of the bore holes or mating bore holes. A second one of the bore holes or mating bore holes has a second maximum radial gap and a second maximum tangential gap relative to the mechanical fastener extending through the second one of the bore holes or mating bore holes. The second maximum radial gap is greater than the first maximum radial gap or the second maximum tangential gap is greater than the first maximum tangential gap.

In another embodiment, a turbomachine is provided. The turbomachine includes a plurality of transition ducts disposed in a generally annular array and including a first transition duct and a second transition duct. Each of the plurality of transition ducts includes an inlet, an outlet, and a passage defining an interior and extending between the inlet and the outlet and defining a longitudinal axis, a radial axis, and a tangential axis. The outlet of each of the plurality of transition ducts is offset from the inlet along the longitudinal axis and the tangential axis. The outlet of at least one transition duct of the plurality of transition ducts includes an inner flange and an outer flange. The turbomachine further includes a support ring assembly downstream of the plurality of transition ducts along a hot gas path, a plurality of bore holes defined in the inner flange and outer flange, and a plurality of mating bore holes defined in the support ring assembly. The turbomachine further includes a plurality of mechanical fasteners connecting the inner flange and the outer flange of the at least one transition duct to the support ring assembly, each of the plurality of mechanical fasteners extending through a bore hole and mating bore hole. A single first one of the bore holes or mating bore holes has a first maximum radial gap and a first maximum tangential gap relative to the mechanical fastener extending through the first one of the bore holes or mating bore holes. A second one of the bore holes or mating bore holes has a second maximum radial gap and a second maximum tangential gap relative to the mechanical fastener extending through the second one of the bore holes or mating bore holes. The second maximum radial gap is greater than the first maximum radial gap or the second maximum tangential gap is greater than the first maximum tangential gap. A plurality of third ones of the bore holes or mating bore holes each have a third maximum radial gap and a third maximum tangential gap relative to the mechanical fastener extending through the third ones of the bore holes or mating bore holes. Each third maximum radial gap is greater than the first maximum radial gap and each third maximum tangential gap is greater than the first maximum tangential gap.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION OF THE DISCLOSURE

Figure 1:
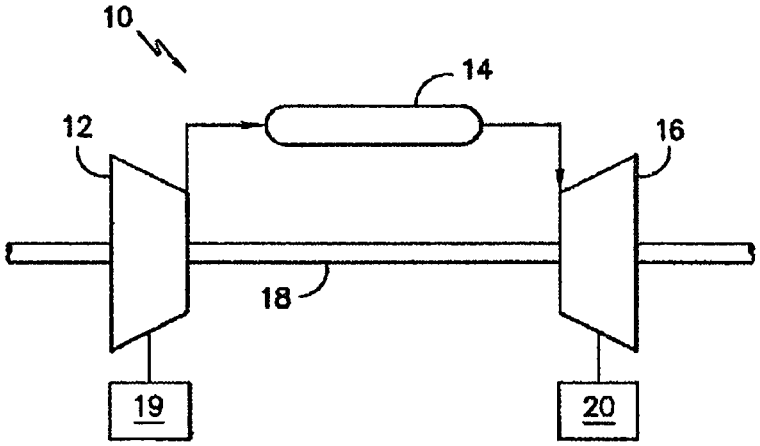
FIG. 1 is a schematic view of a gas turbine system according to embodiments of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

FIG. 1 is a schematic diagram of a turbomachine, which in the embodiment shown is a gas turbine system 10. It should be understood that the turbomachine of the present disclosure need not be a gas turbine system 10, but rather may be any suitable turbine system or other turbomachine, such as a steam turbine system or other suitable system. The system 10 as shown may include a compressor section 12, a combustor section 14 which may include a plurality of combustors 15 as discussed below, and a turbine section 16. The compressor section 12 and turbine section 16 may be coupled by a shaft 18. The shaft 18 may be a single shaft or a plurality of shaft segments coupled together to form shaft 18. The shaft 18 may further be coupled to a generator or other suitable energy storage device, or may be connected directly to, for example, an electrical grid. An inlet section 19 may provide an air flow to the compressor section 12, and exhaust gases may be exhausted from the turbine section 16 through an exhaust section 20 and exhausted and/or utilized in the system 10 or other suitable system. Exhaust gases from the system 10 may for example be exhausted into the atmosphere, flowed to a steam turbine or other suitable system, or recycled through a heat recovery steam generator.

Figure 2:
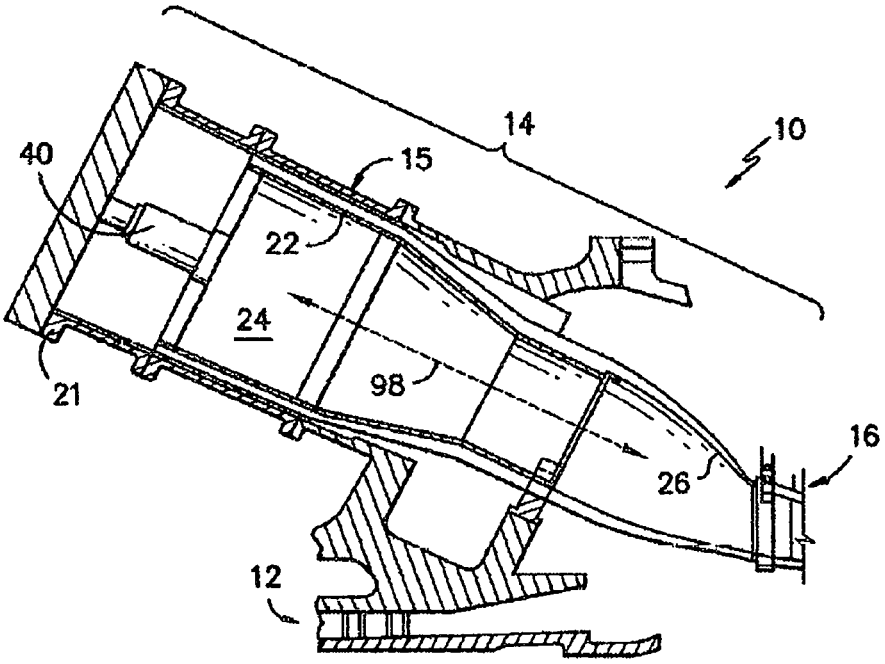
FIG. 2 is a cross-sectional view of several portions of a gas turbine system according to embodiments of the present disclosure.

Referring to FIG. 2, a simplified drawing of several portions of a gas turbine system 10 is illustrated. The gas turbine system 10 as shown in FIG. 2 includes a compressor section 12 for pressurizing a working fluid, discussed below, that is flowing through the system 10. Pressurized working fluid discharged from the compressor section 12 flows into a combustor section 14, which may include a plurality of combustors 15 (only one of which is illustrated in FIG. 2) disposed in an annular array about an axis of the system 10. The working fluid entering the combustor section 14 is mixed with fuel, such as natural gas or another suitable liquid or gas, and combusted. Hot gases of combustion flow from each combustor 15 to a turbine section 16 to drive the system 10 and generate power.

A combustor 15 in the gas turbine 10 may include a variety of components for mixing and combusting the working fluid and fuel. For example, the combustor 15 may include a casing 21, such as a compressor discharge casing 21. A variety of sleeves, which may be axially extending annular sleeves, may be at least partially disposed in the casing 21. The sleeves, as shown in FIG. 2, extend axially along a generally longitudinal axis 98, such that the inlet of a sleeve is axially aligned with the outlet. For example, a combustor liner 22 may generally define a combustion zone 24 therein. Combustion of the working fluid, fuel, and optional oxidizer may generally occur in the combustion zone 24. The resulting hot gases of combustion may flow generally axially along the longitudinal axis 98 downstream through the combustion liner 22 into a transition piece 26, and then flow generally axially along the longitudinal axis 98 through the transition piece 26 and into the turbine section 16.

The combustor 15 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

Referring now to FIGS. 4 through 13, a combustor 15 according to the present disclosure may include one or more transition ducts 50, generally referred to as a transition duct assembly. The transition ducts 50 of the present disclosure may be provided in place of various axially extending sleeves of other combustors. For example, a transition duct 50 may replace the axially extending transition piece 26 and, optionally, the combustor liner 22 of a combustor 15. Thus, the transition duct may extend from the fuel nozzles 40, or from the combustor liner 22. As discussed herein, the transition duct 50 may provide various advantages over the axially extending combustor liners 22 and transition pieces 26 for flowing working fluid therethrough and to the turbine section 16.

As shown, the plurality of transition ducts 50 may be disposed in an annular array about a longitudinal axis 90. Further, each transition duct 50 may extend between a fuel nozzle 40 or plurality of fuel nozzles 40 and the turbine section 16. For example, each transition duct 50 may extend from the fuel nozzles 40 to the turbine section 16. Thus, working fluid may flow generally from the fuel nozzles 40 through the transition duct 50 to the turbine section 16. In some embodiments, the transition ducts 50 may advantageously allow for the elimination of the first stage nozzles in the turbine section, which may eliminate any associated drag and pressure drop and increase the efficiency and output of the system 10.

Each transition duct 50 may have an inlet 52, an outlet 54, and a passage 56 therebetween which may define an interior 57. The inlet 52 and outlet 54 of a transition duct 50 may have generally circular or oval cross-sections, rectangular cross-sections, triangular cross-sections, or any other suitable polygonal cross-sections. Further, it should be understood that the inlet 52 and outlet 54 of a transition duct 50 need not have similarly shaped cross-sections. For example, in one embodiment, the inlet 52 may have a generally circular cross-section, while the outlet 54 may have a generally rectangular cross-section.

Further, the passage 56 may be generally tapered between the inlet 52 and the outlet 54. For example, in an exemplary embodiment, at least a portion of the passage 56 may be generally conically shaped. Additionally or alternatively, however, the passage 56 or any portion thereof may have a generally rectangular cross-section, triangular cross-section, or any other suitable polygonal cross-section. It should be understood that the cross-sectional shape of the passage 56 may change throughout the passage 56 or any portion thereof as the passage 56 tapers from the relatively larger inlet 52 to the relatively smaller outlet 54.

The outlet 54 of each of the plurality of transition ducts 50 may be offset from the inlet 52 of the respective transition duct 50. The term "offset", as used herein, means spaced from along the identified coordinate direction. The outlet 54 of each of the plurality of transition ducts 50 may be longitudinally offset from the inlet 52 of the respective transition duct 50, such as offset along the longitudinal axis 90.

Additionally, in exemplary embodiments, the outlet 54 of each of the plurality of transition ducts 50 may be tangentially offset from the inlet 52 of the respective transition duct 50, such as offset along a tangential axis 92. Because the outlet 54 of each of the plurality of transition ducts 50 is tangentially offset from the inlet 52 of the respective transition duct 50, the transition ducts 50 may advantageously utilize the tangential component of the flow of working fluid through the transition ducts 50 to eliminate the need for first stage nozzles in the turbine section 16, as discussed below.

Further, in exemplary embodiments, the outlet 54 of each of the plurality of transition ducts 50 may be radially offset from the inlet 52 of the respective transition duct 50, such as offset along a radial axis 94. Because the outlet 54 of each of the plurality of transition ducts 50 is radially offset from the inlet 52 of the respective transition duct 50, the transition ducts 50 may advantageously utilize the radial component of the flow of working fluid through the transition ducts 50 to further eliminate the need for first stage nozzles in the turbine section 16, as discussed below.

Figure 4:
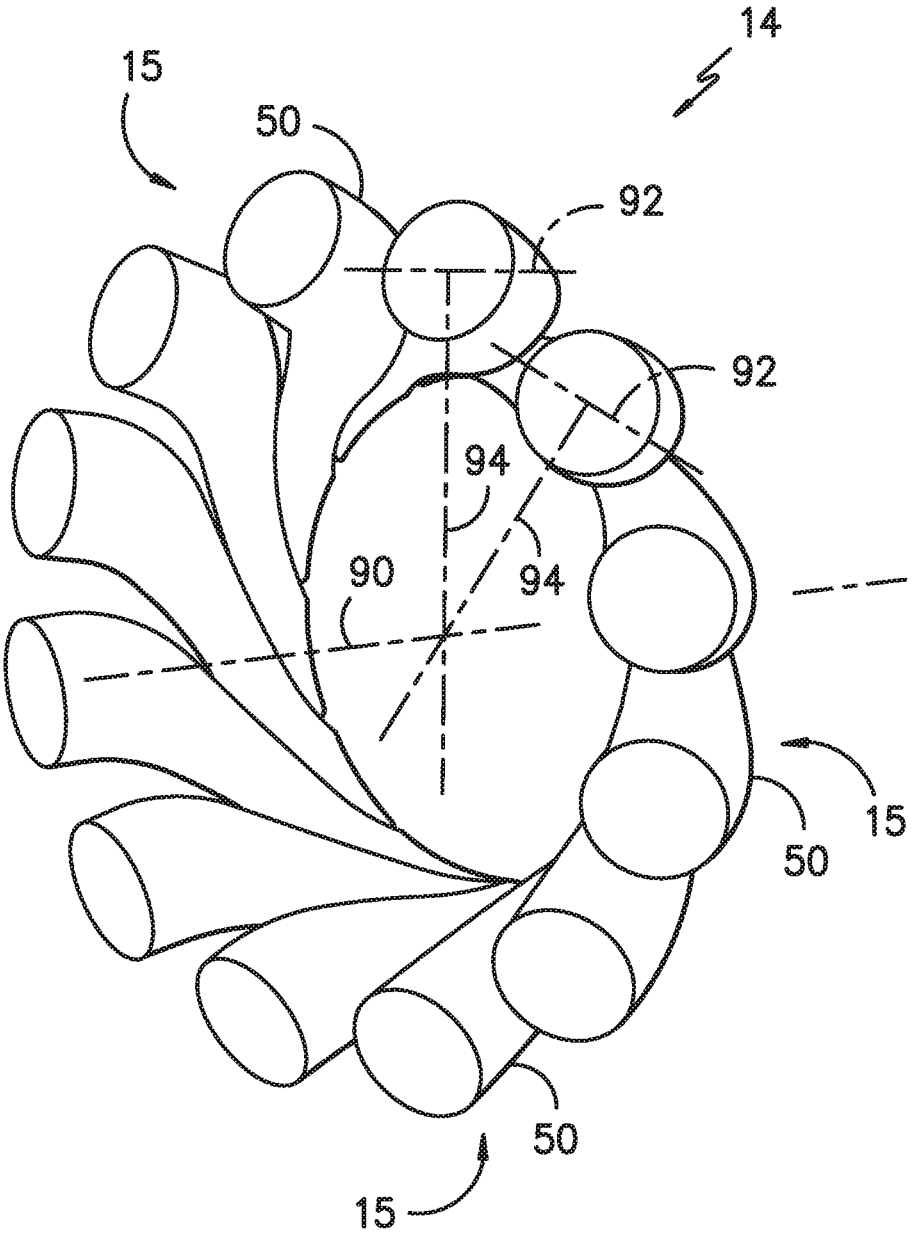
FIG. 4 is a perspective view of an annular array of transition ducts according to embodiments of the present disclosure.

It should be understood that the tangential axis 92 and the radial axis 94 are defined individually for each transition duct 50 with respect to the circumference defined by the annular array of transition ducts 50, as shown in FIG. 4, and that the axes 92 and 94 vary for each transition duct 50 about the circumference based on the number of transition ducts 50 disposed in an annular array about the longitudinal axis 90.

Figure 3:
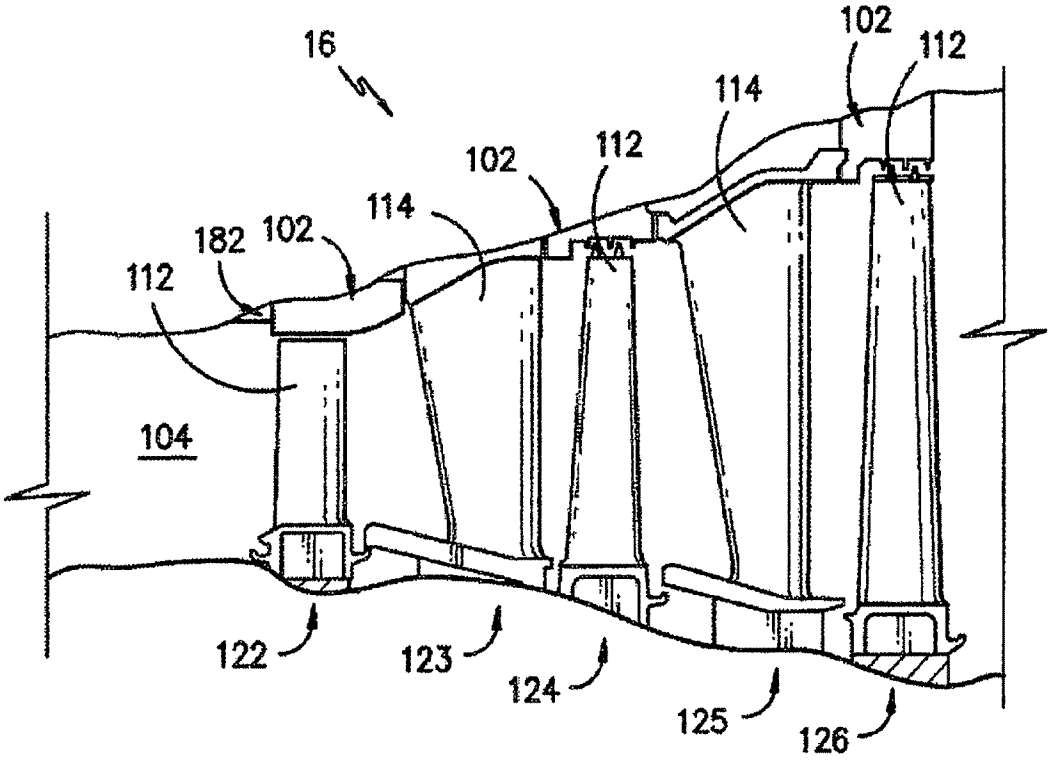
FIG. 3 is a cross-sectional view of a turbine section of a gas turbine system according to embodiments of the present disclosure.

As discussed, after hot gases of combustion are flowed through the transition duct 50, they may be flowed from the transition duct 50 into the turbine section 16. As shown in FIG. 3, a turbine section 16 according to the present disclosure may include a shroud 102, which may define a hot gas path 104. The shroud 102 may be formed from a plurality of shroud blocks. The shroud blocks may be disposed in one or more annular arrays, each of which may define a portion of the hot gas path 104 therein. Turbine section 16 may additionally include a support ring assembly, which may include a lower support ring 180 and an upper support ring 182 and which may for example be positioned upstream (along the hot gas path 104) of the shroud 102 (such as the first plurality of shroud blocks thereof) or may be a first portion of the shroud 102. The support ring assembly may further define the hot gas path 104 (i.e. between the lower and upper support rings 180, 182), and provides the transition between the transition ducts 50 and the turbine section 16. Accordingly, the support ring assembly (and support rings 180, 182 thereof) may be downstream (along the hot gas path 104) of the plurality of transition ducts 50. Hot gas may flow from the transition ducts 50 into and through the support ring assembly (between the support rings 180, 182), and from the support ring assembly through the remainder of the turbine section 16. It should be noted that the support rings may be conventionally referred to nozzle support rings or first stage nozzle support rings. However, as discussed herein, no first stage nozzles may be utilized with transition ducts 50 in accordance with exemplary embodiments of the present disclosure, and thus the support rings in exemplary embodiments do not surround any first stage or other nozzles.

The turbine section 16 may further include a plurality of buckets 112 and a plurality of nozzles 114. Each of the plurality of buckets 112 and nozzles 114 may be at least partially disposed in the hot gas path 104. Further, the plurality of buckets 112 and the plurality of nozzles 114 may be disposed in one or more annular arrays, each of which may define a portion of the hot gas path 104.

The turbine section 16 may include a plurality of turbine stages. Each stage may include a plurality of buckets 112 disposed in an annular array and a plurality of nozzles 114 disposed in an annular array. For example, in one embodiment, the turbine section 16 may have three stages, as shown in FIG. 3. For example, a first stage of the turbine section 16 may include a first stage nozzle assembly (not shown) and a first stage buckets assembly 122. The nozzles assembly may include a plurality of nozzles 114 disposed and fixed circumferentially about the shaft 18. The bucket assembly 122 may include a plurality of buckets 112 disposed circumferentially about the shaft 18 and coupled to the shaft 18. In exemplary embodiments wherein the turbine section is coupled to combustor section 14 including a plurality of transition ducts 50, however, the first stage nozzle assembly may be eliminated, such that no nozzles are disposed upstream of the first stage bucket assembly 122. Upstream may be defined relative to the flow of hot gases of combustion through the hot gas path 104.

A second stage of the turbine section 16 may include a second stage nozzle assembly 123 and a second stage buckets assembly 124. The nozzles 114 included in the nozzle assembly 123 may be disposed and fixed circumferentially about the shaft 18. The buckets 112 included in the bucket assembly 124 may be disposed circumferentially about the shaft 18 and coupled to the shaft 18. The second stage nozzle assembly 123 is thus positioned between the first stage bucket assembly 122 and second stage bucket assembly 124 along the hot gas path 104. A third stage of the turbine section 16 may include a third stage nozzle assembly 125 and a third stage bucket assembly 126. The nozzles 114 included in the nozzle assembly 125 may be disposed and fixed circumferentially about the shaft 18. The buckets 112 included in the bucket assembly 126 may be disposed circumferentially about the shaft 18 and coupled to the shaft 18. The third stage nozzle assembly 125 is thus positioned between the second stage bucket assembly 124 and third stage bucket assembly 126 along the hot gas path 104.

It should be understood that the turbine section 16 is not limited to three stages, but rather that any number of stages are within the scope and spirit of the present disclosure.

Each transition duct 50 may interface with one or more adjacent transition ducts 50. For example, FIGS. 5 through 13 illustrate embodiments of a first transition duct 130 and a second transition duct 132 of the plurality of transition ducts 50. These neighboring transition ducts 130, 132 may include contact faces 134, which may be outer surfaces included in the outlets of the transition duct 50. The contact faces 134 may contact associated contact faces 134 of adjacent neighboring transition ducts 50 and/or the support ring assembly (and support rings 180, 182 thereof), as shown, to provide an interface between the transition ducts 50 and/or between the transition ducts 50 and the support ring assembly. For example, contact faces 134 of the first and second transition ducts 130, 132 may, as shown, contact each other and provide an interface between the first and second transition ducts 130, 132. Further, contact faces 134 of the first and second transition ducts 130, 132 may, as shown, contact the support ring assembly and provide an interface between the transition ducts 130, 132 and the support ring assembly. As discussed herein, seals may be provided between the various contact faces to facilitate sealing at such interfaces. Notably, contact as discussed herein may include direct contact between the components themselves or indirect component through seals disposed between the components.

Figure 7:
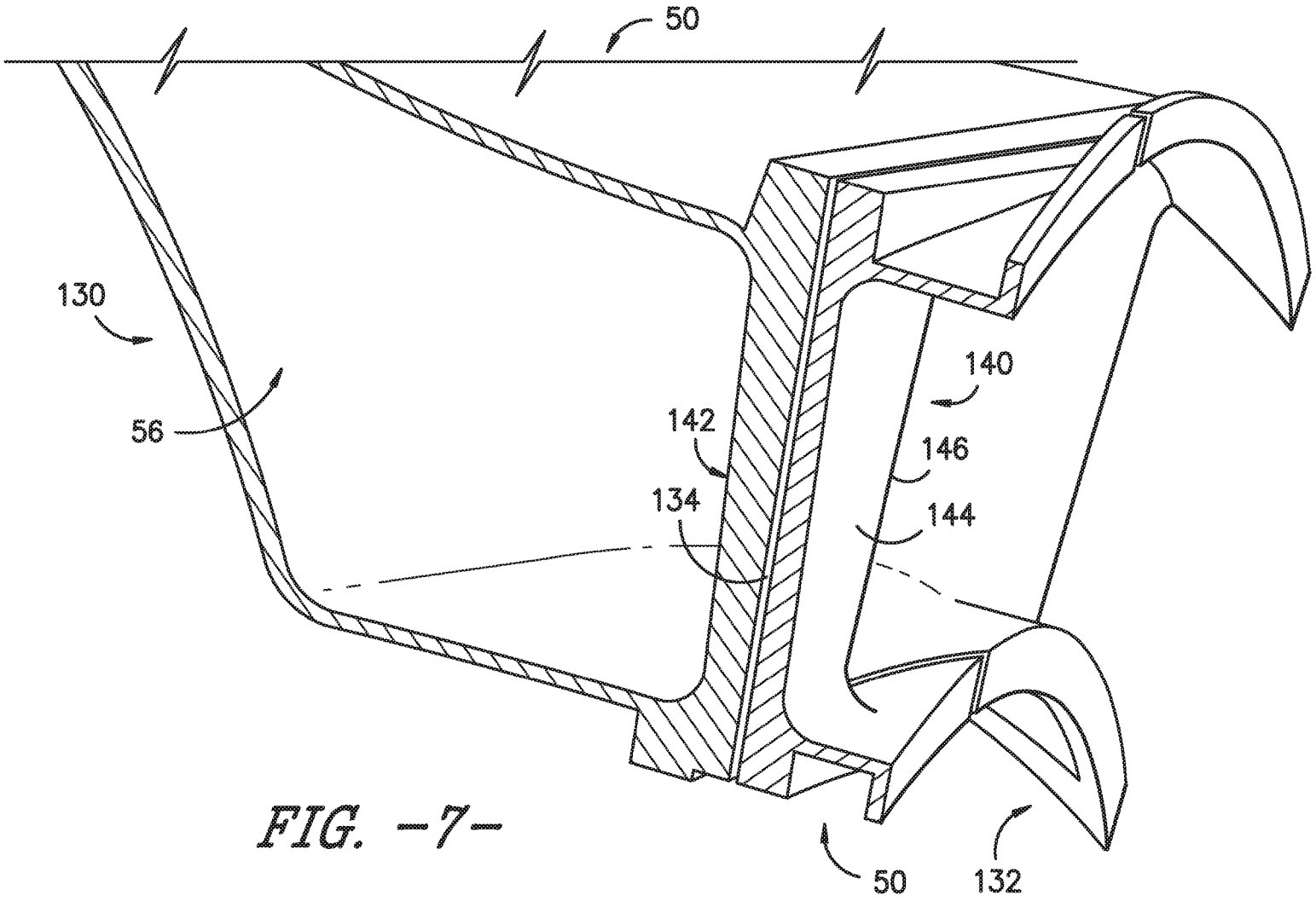
FIG. 7 is a cutaway perspective view of a transition duct assembly, including neighboring transition ducts and forming various portions of an airfoil therebetween according to embodiments of the present disclosure.
Figure 8:
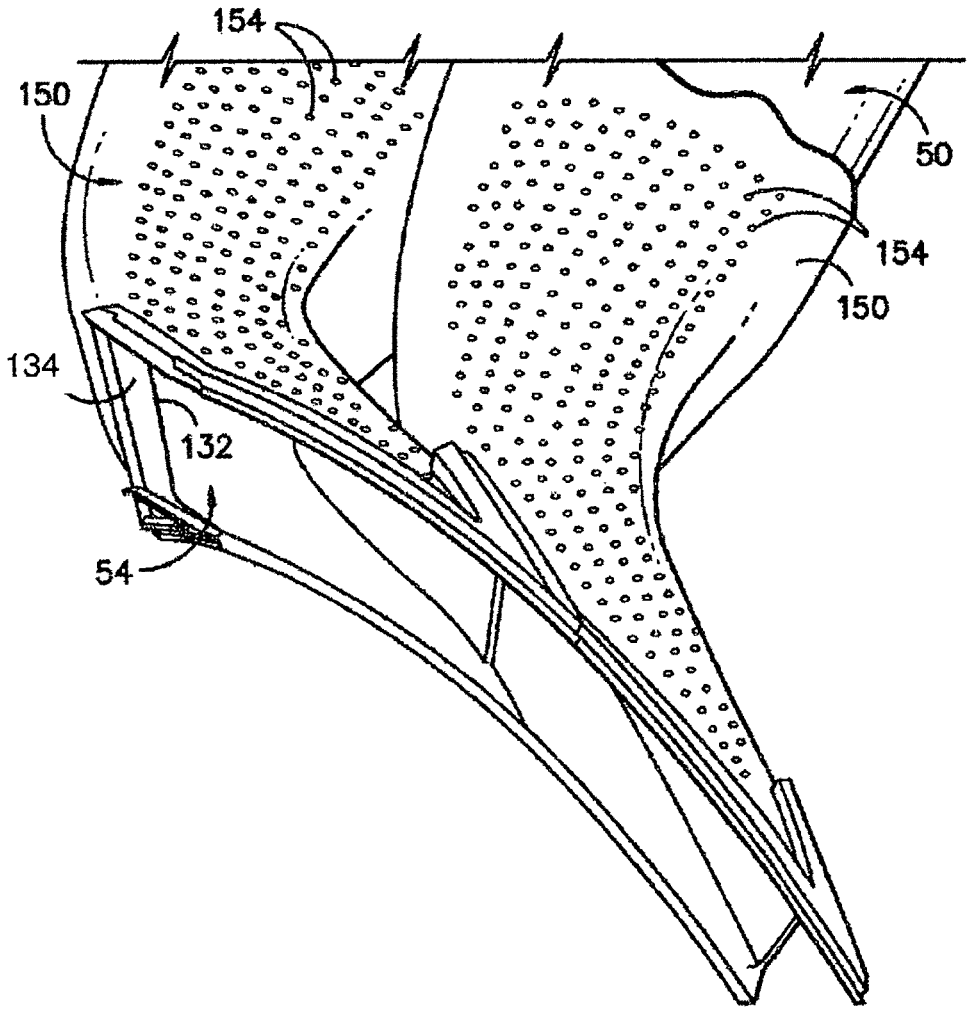
FIG. 8 is a top front perspective view of a plurality of transition ducts and associated impingement sleeves according to embodiments of the present disclosure.
Figure 9:
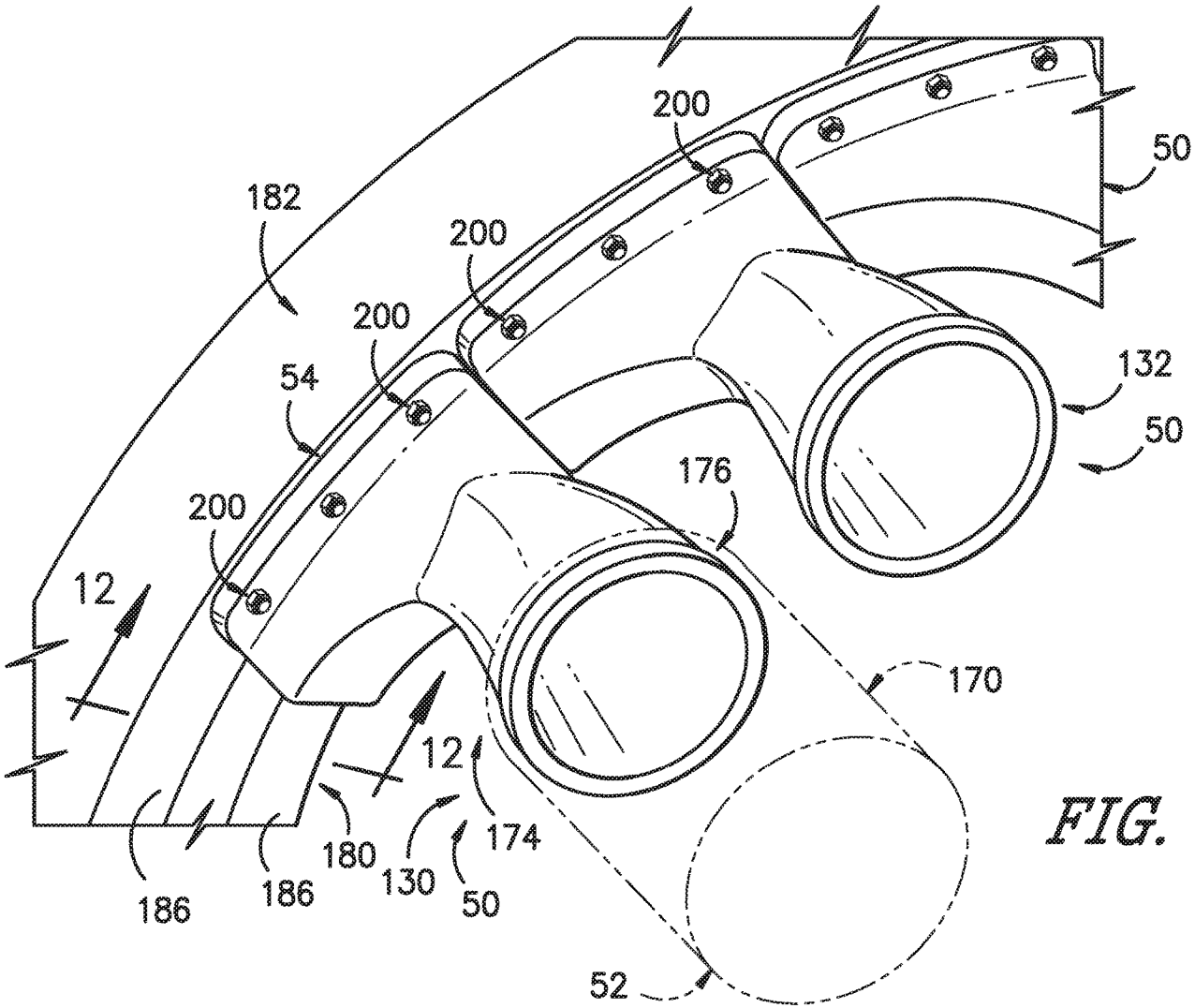
FIG. 9 is a top rear perspective view of a plurality of transition ducts connected to a support ring assembly according to embodiments of the present disclosure.
Figure 10:
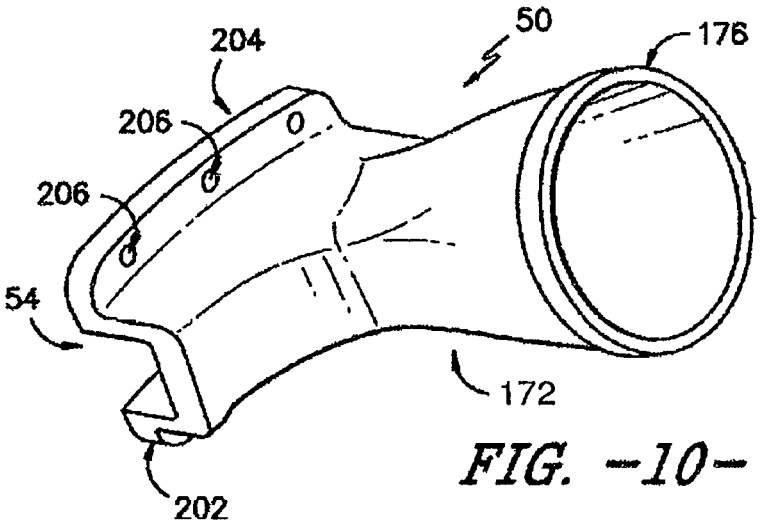
FIG. 10 is a side perspective view of a downstream portion of a transition duct according to embodiments of the present disclosure.
Figure 11:
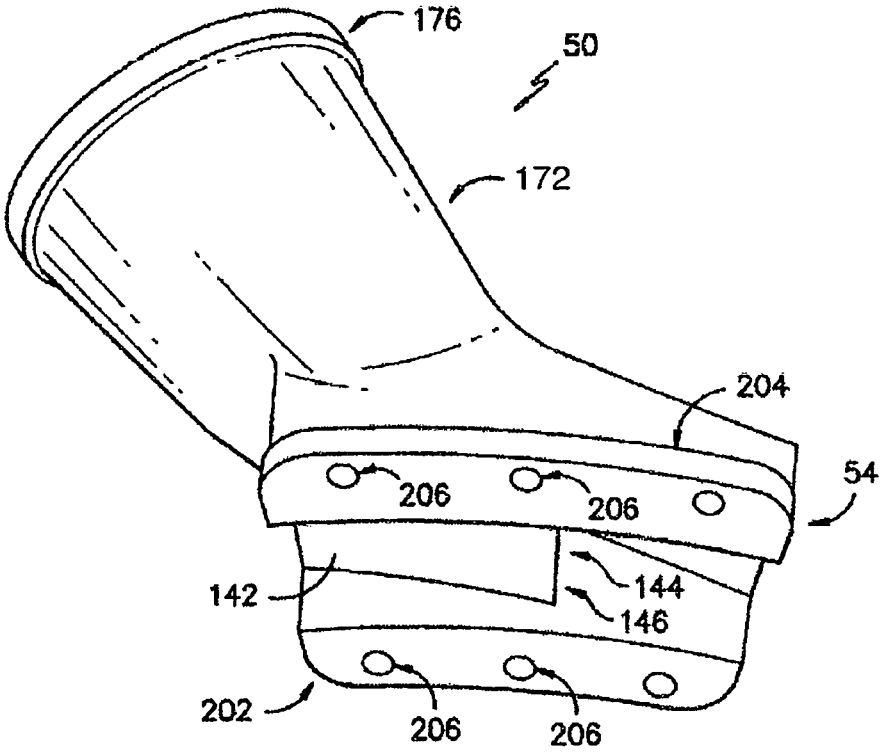
FIG. 11 is a front perspective view of a downstream portion of a transition duct according to embodiments of the present disclosure.

Further, the transition ducts 50, such as the first and second transition ducts 130, 132, may form aerodynamic structures 140 having various aerodynamic surface of an airfoil. Such aerodynamic structure 140 may, for example, be defined by inner surfaces of the passages 56 of the transition ducts 50, and further may be formed when contact faces 134 of adjacent transition ducts 50 interface with each other. These various surfaces may shift the hot gas flow in the transition ducts 50, and thus eliminate the need for first stage nozzles, as discussed herein. For example, in some embodiments as illustrated in FIGS. 7 and 8, an inner surface of a passage 56 of a transition duct 50, such as a first transition duct 130, may define a pressure side 142, while an opposing inner surface of a passage 56 of an adjacent transition duct 50, such as a second transition duct 132, may define a suction side 144. When the adjacent transition ducts 50, such as the contact faces 134 thereof, interface with each other, the pressure side 142 and suction side 144 may combine to define a trailing edge 146. In other embodiments, as illustrated in FIG. 11, inner surfaces of a passage 56 of a transition duct 50, such as a first transition duct 130, may define a pressure side 142 and a suction side 144 as well as a trailing edge therebetween. Inner surfaces of a passage 56 of a neighboring transition duct 50, such as a second transition duct 132, may further define the pressure side 142 and/or the suction side 144.

Figure 5:
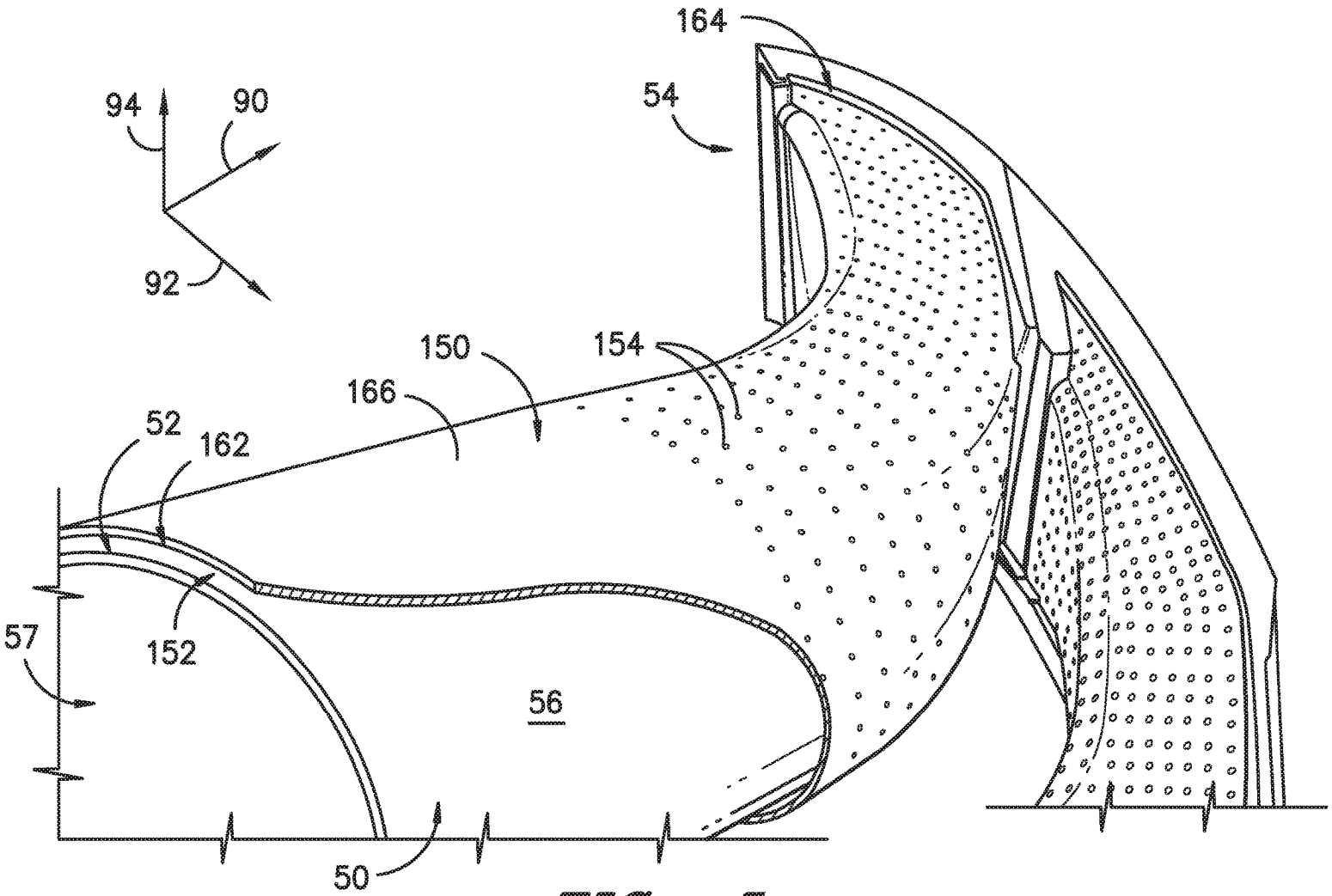
FIG. 5 is a top perspective view of a plurality of transition ducts and associated impingement sleeves according to embodiments of the present disclosure.
Figure 6:
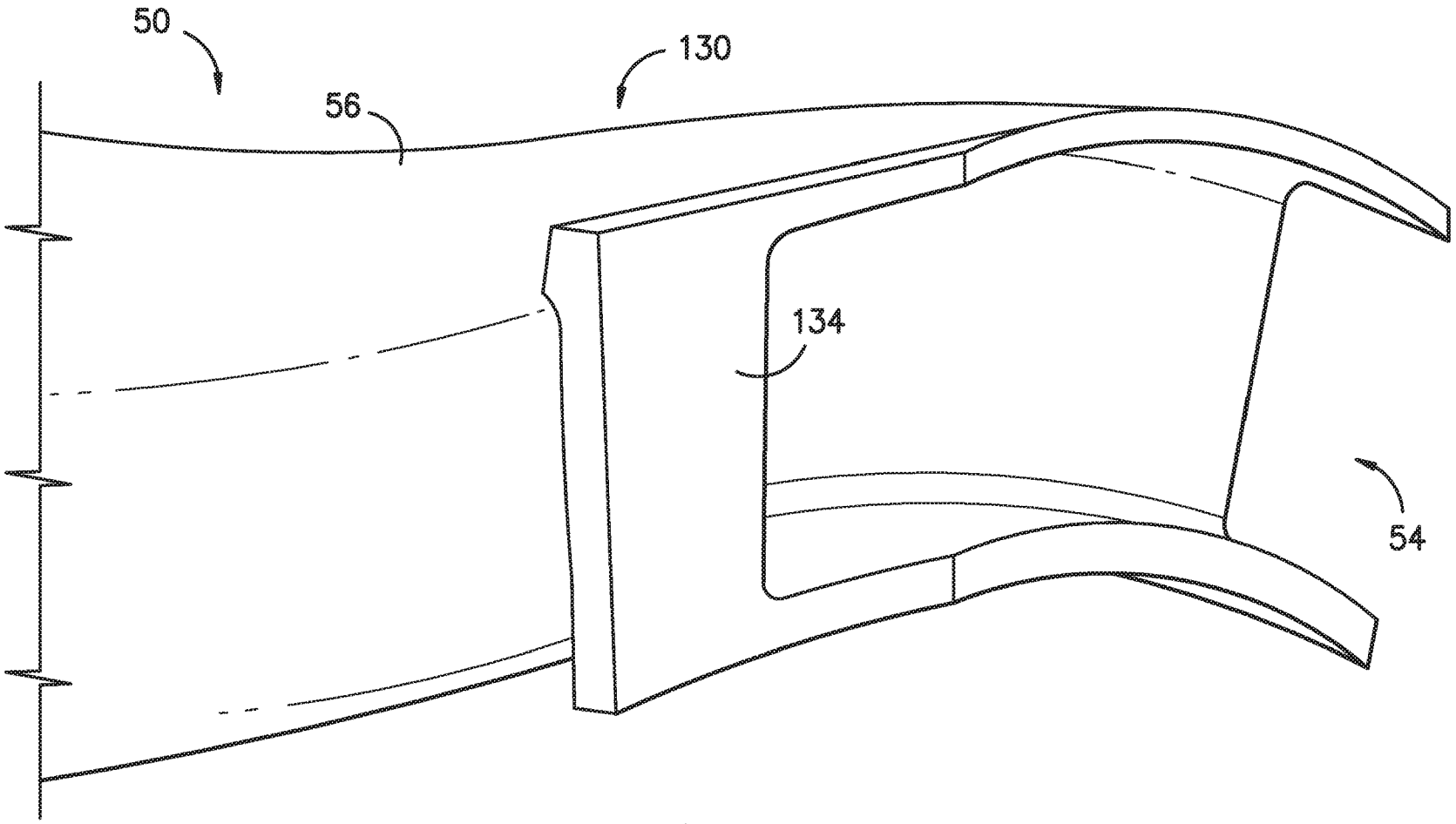
FIG. 6 is a side perspective view of a transition duct according to embodiments of the present disclosure.

As shown in FIGS. 5 and 8, in exemplary embodiments, flow sleeves 150 may circumferentially surround at least a portion of the transition ducts 50. A flow sleeve 150 circumferentially surrounding a transition duct 50 may define an annular passage 152 therebetween. Compressed working fluid from the casing 21 may flow through the annular passage 152 to provide convective cooling transition duct 50 before reversing direction to flow through the fuel nozzles 40 and into the transition duct 50. Further, in some embodiments, the flow sleeve 150 may be an impingement sleeve. In these embodiments, impingement holes 154 may be defined in the sleeve 150, as shown. Compressed working fluid from the casing 21 may flow through the impingement holes 154 and impinge on the transition duct 50 before flowing through the annular passage 152, thus providing additional impingement cooling of the transition duct.

Each flow sleeve 150 may have an inlet 162, an outlet 164, and a passage 166 therebetween. Each flow sleeve 150 may extend between a fuel nozzle 40 or plurality of fuel nozzles 40 and the turbine section 16, thus surrounding at least a portion of the associated transition duct 50. Thus, similar to the transition ducts 50, as discussed above, the outlet 164 of each of the plurality of flow sleeves 150 may be longitudinally, radially, and/or tangentially offset from the inlet 162 of the respective flow sleeve 150.

In some embodiments, as illustrated in FIGS. 5 and 8, a transition duct 50 according to the present disclosure is a single, unitary component extending between the inlet 52 and the outlet 54. In other embodiments, as illustrated in FIGS. 9 through 13, a transition duct 50 according to the present disclosure may include a plurality of sections or portions, which are articulated with respect to each other. This articulation of the transition duct 50 may allow the various portions of the transition duct 50 to move and shift relative to each other during operation, allowing for and accommodating thermal growth thereof. For example, a transition duct 50 may include an upstream portion 170 and a downstream portion 172. The upstream portion 170 may include the inlet 52 of the transition duct 50 and may extend generally downstream therefrom towards the outlet 54. The downstream portion 172 may include the outlet 54 of the transition duct 50 and may extend generally upstream therefrom towards the inlet 52. The upstream portion 170 may thus include and extend between the inlet 52 and an aft end 174, and the downstream portion 172 may include and extend between a head end 176 and the outlet 54.

A joint may couple the upstream portion 170 and downstream portion 172 together and may provide the articulation between the upstream portion 170 and downstream portion 172 that alows the transition duct 50 to move during operation of the turbomachine. Specifically, the joint may couple the aft end 174 and the head end 176 together. The joint may be configured to allow movement of the upstream portion 170 and/or the downstream portion 172 relative to one another about or along at least one axis. Further, in some embodiments, the joint may be configured to allow such movement about or along at least two axes, such as about or along three axes. The axis or axes can be any one or more of the longitudinal axis 90, the tangential axis 92, and/or the radial axis 94. Movement about one of these axes may thus mean that one of the upstream portion 170 and/or the downstream portion 172 (or both) can rotate or otherwise move about the axis with respect to the other due to the joint providing this degree of freedom between the upstream portion 170 and downstream portion 172. Movement along one of these axes may thus mean that one of the upstream portion 170 or the downstream portion 172 (or both) can translate or otherwise move along the axis with respect to the other due to the joint providing this degree of freedom between the upstream portion 170 and downstream portion 172. In exemplary embodiments the joint may be a hula seal. Alternatively, other suitable seals or other joints may be utilized.

In some embodiments, use of an upstream portion 170 and downstream portion 172 can advantageously allow specific materials to be utilized for these portions. For example, the downstream portions 172 can advantageously be formed from ceramic materials, such as ceramic matrix composites. The upstream portions 170 and flow sleeves 150 can be formed from suitable metals. Use of ceramic materials is particularly advantageous due to their relatively higher temperature tolerances. Ceramic material can in particular be advantageously utilized for downstream portions 172 when the downstream portions 172 are connected to the support ring assembly (as discussed herein) and the upstream portions 170 can move relative to the downstream portions 172, as movement of the downstream portions 172 is minimized, thus lessening concerns about using relatively brittle ceramic materials.

In some embodiments, the interface between the transition ducts 50, such as the outlets 54 thereof, and the support ring assembly (and support rings 180, 182 thereof) may be a floating interface. For example, the outlets 54 may not be connected to the support rings 180, 182 and may be allowed to move relative to the support rings 180, 182. This may allow for thermal growth of the transition ducts 50 during operation. Suitable floating seals, which can accommodate such movement, may be disposed between the outlets 54 and the support rings 180, 182. Alternatively, and referring now to FIGS. 9 through 13, in some embodiments, the interface between the transition ducts 50, such as the outlets 54 thereof, and the support rings 180, 182 may be a connected interface. In exemplary embodiments, for example, connected interfaces may be utilized with articulated transition ducts that include upstream and downstream portions 170, 172.

For example, as illustrated, a plurality of mechanical fasteners 200 may be provided. The mechanical fasteners 200 may connect one or more of the transition ducts 50 (such as the outlets 54 thereof), including for example the first and/or second transition ducts 130, 132, to contact surfaces 186 of the support ring assembly (and support rings 180, 182 thereof). In exemplary embodiments as illustrated, a mechanical fastener 200 in accordance with the present disclosure includes a bolt and may for example be a nut/bolt combination. In alternative embodiments, a mechanical fastener in accordance with the present disclosure may be or include a pin, screw, nail, rivet, etc.

As illustrated, mechanical fasteners 200 may extend through portions of the transition ducts 50 (such as the outlets 54 thereof) and support ring assembly (and support rings 180, 182 thereof) to connect these components together. The outlet 54 of a transition duct 50 may, for example, include an inner flange 202 and/or outer flange 204 (which may be/define contact faces 134 of the transition duct 50). The inner flange 202 may be disposed radially inward of the outer flange 204, and an opening of the outlet 54 through which hot gas flows from the transition duct 50 into and through the support ring assembly (between the support rings 180, 182) may be defined between the inner flange 202 and the outer flange 204. Bore holes 206 may be defined in the inner 202 and outer flanges 204, respectively. The bore holes 206 may align with mating bore holes 181, 183 defined in the support ring 180, 182, and mechanical fasteners 200 may extend through each bore hole 206 and mating bore hole 181, 183 to connect the flanges 202, 204 and support rings 180, 182 together.

Figure 12:
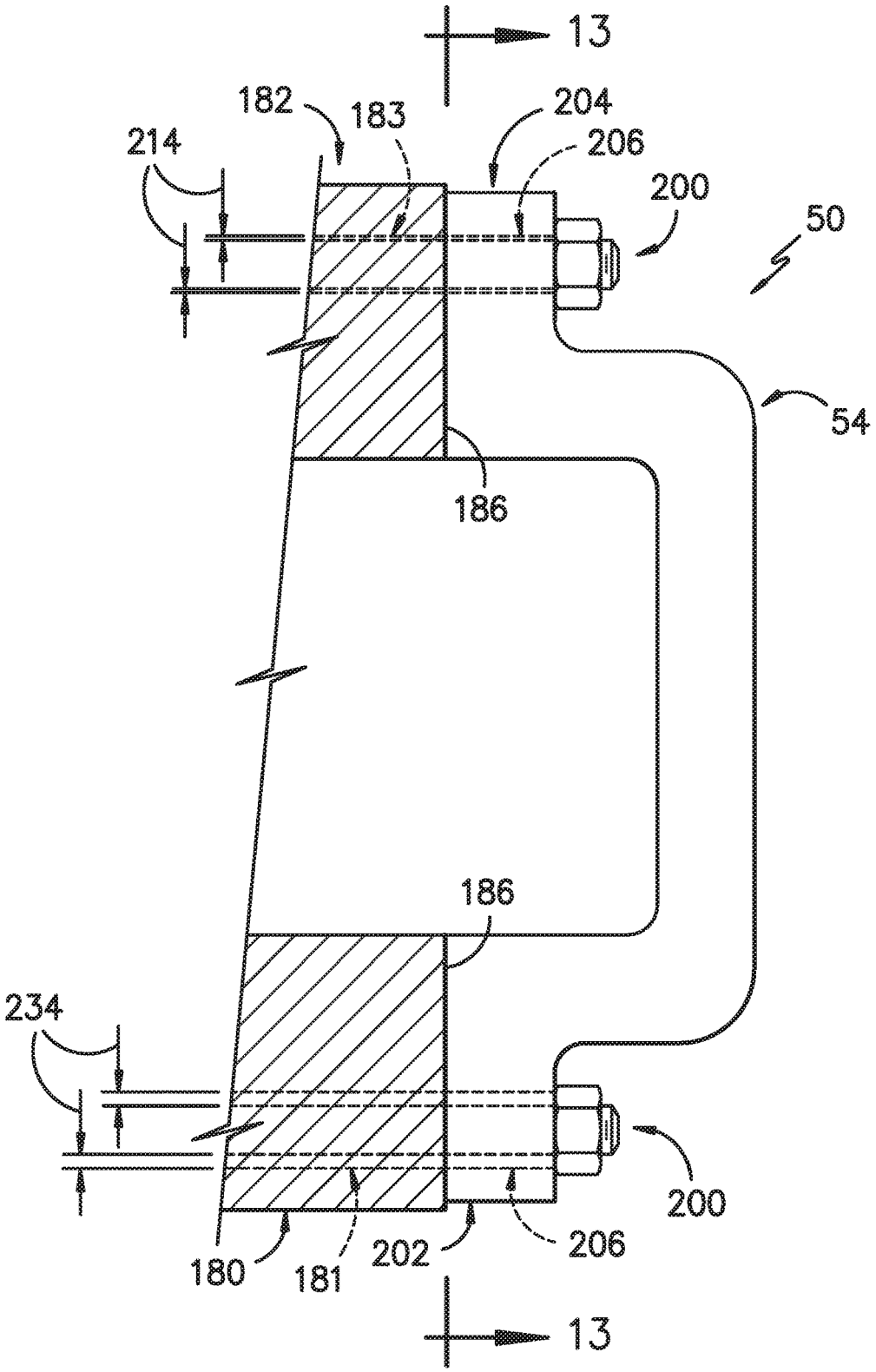
FIG. 12 is a cross-sectional view of a transition duct connected to a support ring assembly according to embodiments of the present disclosure.
Figure 13:
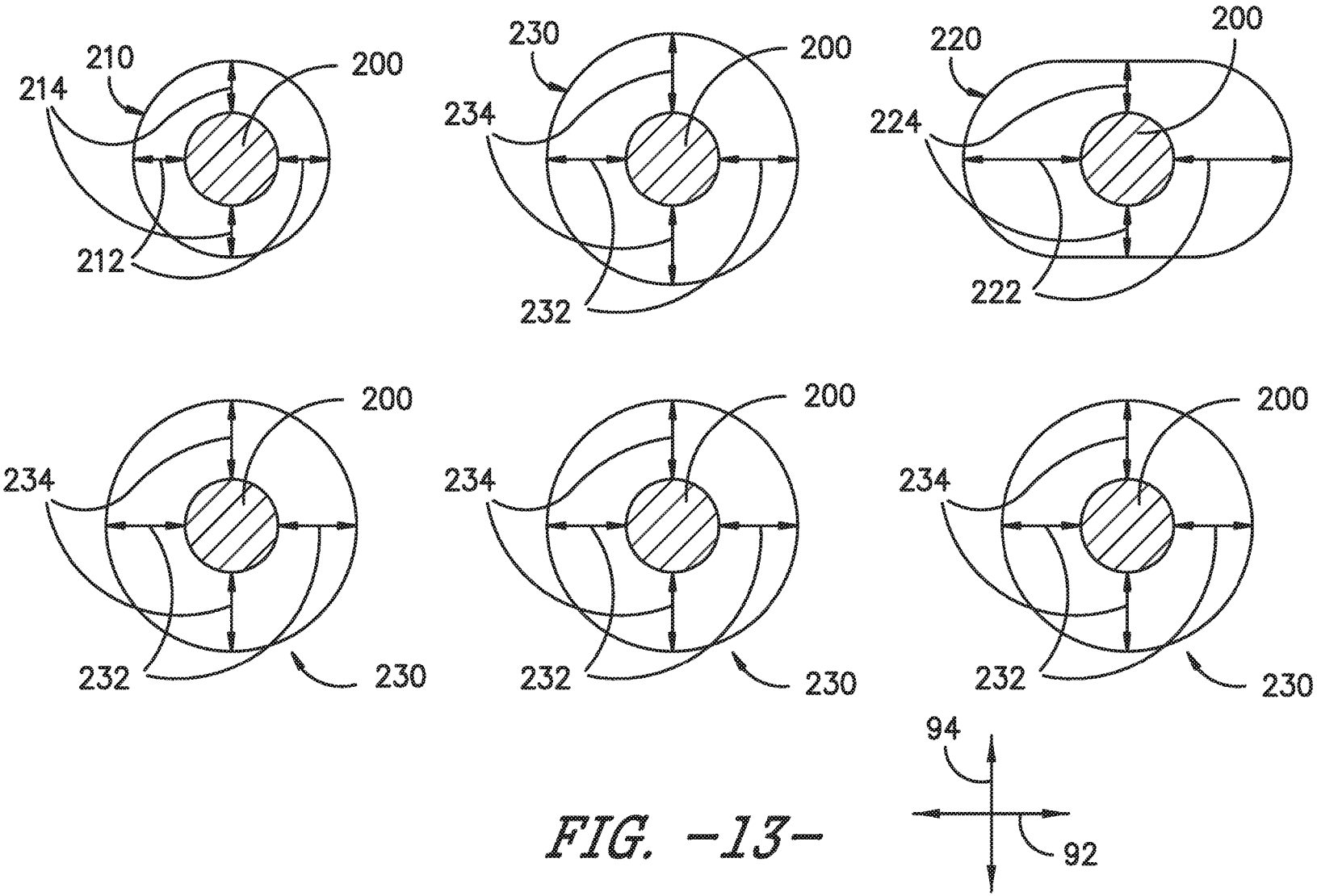
FIG. 13 is a schematic view illustrating gaps between mechanical fasteners and bore holes/mating bore holes according to embodiments of the present disclosure.

Referring now in particular to FIGS. 12 and 13, in exemplary embodiments, tolerances between the bore holes 206 and/or bore holes 181, 183 and the mechanical fasteners 200 extending therethrough may advantageously be particularly sized to accommodate thermal expansion of the transition ducts 50 during operation while maintaining suitable connections between the transition ducts 50 and the support ring assembly (and support rings 180, 182 thereof). The transition ducts 50, such as in exemplary embodiments the downstream portions 172, may thus be allowed to move along their tangential axes 92 and/or radial axes 94 in sufficient amounts to accommodate such thermal expansion. However, the mechanical connections between the transition ducts 50, such as the downstream portions 172, and the support ring assembly (such as the support rings 180, 182 thereof) may advantageously be maintained while such thermal expansion is allowed.

Differing gaps may thus be defined for the various bore holes 206 and/or mating bore holes 181, 183 relative to the mechanical fasteners 200 extending therethrough. In some embodiments, the differing gaps as discussed herein are only defined for bore holes 206 relative to mechanical fasteners 200. In other embodiments, the differing gaps as discussed herein are only defined for mating bore holes 181, 183 relative to associated mechanical fasteners 200. In other embodiments, the differing gaps as discussed herein are defined for both bore holes 206 and mating bore holes 181, 183 relative to associated mechanical fasteners 200.

A gap for a bore hole 206/mating bore hole 181, 183 relative to a mechanical fastener 200 in accordance with the present disclosure is a difference in diameters along an axis (such as a tangential axis 92 or radial axis 94). Specifically, a gap is a difference between an inner diameter (or width) of a bore hole 206/mating bore hole 181, 183 and an outer diameter (or width) of the portion of a mechanical fastener 200 that is disposed within the bore hole 206/mating bore hole 181, 183.

Accordingly, a first one 210 of the bore holes 206 and/or mating bore holes 181, 183 may have a first maximum radial gap 212 (i.e. a maximum gap along the radial axis 94 of the subject transition duct 50) and a first maximum tangential gap 214 (i.e. a maximum gap along the tangential axis 92 of the subject transition duct 50) relative to the mechanical fastener 200 extending through the first one 210 of the bore holes 206 and/or mating bore holes 181, 183. In exemplary embodiments, the plurality of bore holes 206 of a transition duct 50 and/or the plurality of mating bore holes 181, 183 connecting the support ring assembly (and support rings 180, 182 thereof) to the subject transition duct 50 may include only a single first one 210.

The gaps 212 and 214 are small enough relative to other gaps as discussed herein such that the first one 210 acts as a pivot point for the transition duct 50 relative to the support ring assembly (and support rings 180, 182 thereof). For example, in some embodiments, the first maximum radial gap 212 is less than or equal to 0.010 inches, such as less than 0.008 inches. Further, in some embodiments, the first maximum tangential gap 214 is less than or equal to 0.010 inches, such as less than 0.008 inches.

Further, one or more second ones 220 of the bore holes 206 and/or mating bore holes 181, 183 may have a second maximum radial gap 222 (i.e. a maximum gap along the radial axis 94 of the subject transition duct 50) and a second maximum tangential gap 224 (i.e. a maximum gap along the tangential axis 92 of the subject transition duct 50) relative to the mechanical fastener 200 extending through the second one(s) 220 of the bore holes 206 and/or mating bore holes 181, 183. In exemplary embodiments, the plurality of bore holes 206 of a transition duct 50 and/or the plurality of mating bore holes 181, 183 connecting the support ring assembly (and support rings 180, 182 thereof) to the subject transition duct 50 may include only a single second one 220. Alternatively, multiple second ones 220 may be included.

The second maximum radial gap 222 may be greater than the first maximum radial gap 212 and/or the second maximum tangential gap 224 may be greater than the first maximum tangential gap 214. In exemplary embodiments, only one of the second maximum radial gap 222 or second maximum tangential gap 224 is greater than the relative first maximum radial gap 212 or first maximum tangential gap 214. For example, in particular exemplary embodiments, the second maximum tangential gap 224 is greater than the first maximum tangential gap 214. Alternatively, both the second maximum radial gap 222 is greater than the first maximum radial gap 212 and the second maximum tangential gap 224 is greater than the first maximum tangential gap 214.

The greater-sized gap(s) 222 and/or 224 may advantageously allow thermal expansion of the transition duct 50 (such as in exemplary embodiments the downstream portion 172 thereof) by allowing relatively greater movement of the mechanical fastener 200 within the second one(s) 220 along one or both of the tangential axis 92 or radial axis 94 of the transition duct 50. For example, in some embodiments, the second maximum radial gap 222 is less than or equal to 0.200 inches, such as less than 0.150 inches. Further, in some embodiments, the second maximum tangential gap 224 is less than or equal to 0.200 inches, such as less than 0.150 inches. Notably, as discussed, the second maximum radial gap 222 may be greater than the relative first maximum radial gap 212 and/or the second maximum tangential gap 224 may be greater than the relative first maximum tangential gap 214. Accordingly, the second maximum radial gap 222 may for example be between 0.015 inches and 0.200 inches, such as between 0.020 inches and 0.150 inches, and/or the second maximum tangential gap 224 may for example be between 0.015 inches and 0.200 inches, such as between 0.020 inches and 0.150 inches. Further, in embodiments wherein only one of the second maximum radial gap 222 or second maximum tangential gap 224 is greater than the relative first maximum radial gap 212 or first maximum tangential gap 214, the other of the second maximum radial gap 222 or second maximum tangential gap 224 may in some embodiments be less than or equal to 0.010 inches, such as less than or equal to 0.008 inches.

Still further, one or more third ones 230 of the bore holes 206 and/or mating bore holes 181, 183 may have a third maximum radial gap 232 (i.e. a maximum gap along the radial axis 94 of the subject transition duct 50) and a third maximum tangential gap 234 (i.e. a maximum gap along the tangential axis 92 of the subject transition duct 50) relative to the mechanical fastener 200 extending through the third one(s) 230 of the bore holes 206 and/or mating bore holes 181, 183. In exemplary embodiments, the plurality of bore holes 206 of a transition duct 50 and/or the plurality of mating bore holes 181, 183 connecting the support ring assembly (and support rings 180, 182 thereof) to the subject transition duct 50 may include a plurality of third ones 230.

The third maximum radial gap 232 may be greater than the first maximum radial gap 212 and the third maximum tangential gap 234 may be greater than the first maximum tangential gap 214. The greater-sized gap(s) 232 and 234 may advantageously allow thermal expansion of the transition duct 50 (such as in exemplary embodiments the downstream portion 172 thereof) by allowing relatively greater movement of the mechanical fastener 200 within the third one(s) 230 along one or both of the tangential axis 92 or radial axis 94 of the transition duct 50. For example, in some embodiments, the third maximum radial gap 232 is less than or equal to 0.200 inches, such as less than 0.150 inches. Further, in some embodiments, the third maximum tangential gap 234 is less than or equal to 0.200 inches, such as less than 0.150 inches. Notably, as discussed, the third maximum radial gap 232 may be greater than the relative first maximum radial gap 212 and the third maximum tangential gap 234 may be greater than the relative first maximum tangential gap 214. Accordingly, the third maximum radial gap 232 may for example be between 0.015 inches and 0.200 inches, such as between 0.020 inches and 0.150 inches, and the third maximum tangential gap 234 may for example be between 0.015 inches and 0.200 inches, such as between 0.020 inches and 0.150 inches.

In order to facilitate such movement of the transition duct(s) 50 relative to the support ring assembly (and support rings 180, 182 thereof), in some embodiments a plurality of biasing elements (not shown) may be provided. Each biasing element may be at least partially disposed within a bore hole 206 and/or mating bore hole 181, 183, such as between the interior surface of the bore hole 206/mating bore hole 181, 183 and the portion the mechanical fastener 200 extending therethrough. The biasing elements may dampen movement of the transition duct 50 and/or associated mechanical fastener 200, thus reducing damage to the transition duct 50, mechanical fasteners 200 and/or support ring assembly (and support rings 180, 182 thereof) during operation. In exemplary embodiments, a biasing element may be a Belleville washer (also known as a coned-disc spring, conical spring washer, disc spring, Belleville spring or cupped spring washer). Alternatively, other suitable springs, elastic materials, etc. are within the scope and spirit of the present disclosure.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbomachine, comprising:

a plurality of transition ducts disposed in a generally annular array and comprising a first transition duct and a second transition duct, each of the plurality of transition ducts comprising an upstream portion including an inlet and an aft end opposite the inlet, a downstream portion including an outlet and a head end opposite the outlet, and a passage defining an interior and extending between the inlet and the outlet and defining a longitudinal axis, a radial axis, and a tangential axis, the outlet of each of the plurality of transition ducts offset from the inlet along the longitudinal axis and the tangential axis, the outlet of at least one transition duct of the plurality of transition ducts comprising an inner flange and an outer flange, wherein a plurality of bore holes are defined in the inner flange and the outer flange of the outlet of the at least one transition duct; and wherein an unbolted joint is defined between the aft end of the upstream portion and the head end of the downstream portion of each transition duct of the plurality of transition ducts, the unbolted joint being configured to permit movement between the upstream portion and the downstream portion along the longitudinal axis, the radial axis, and the tangential axis;

a support ring assembly downstream of the plurality of transition ducts along a hot gas path, wherein a plurality of mating bore holes are defined in the support ring assembly; and a plurality of mechanical fasteners connecting the inner flange and the outer flange of the at least one transition duct to the support ring assembly, each of the plurality of mechanical fasteners extending through a bore hole and a mating bore hole, wherein a first one of the bore holes or mating bore holes has a first maximum radial gap and a first maximum tangential gap relative to the mechanical fastener extending through the first one of the bore holes or mating bore holes, wherein a second one of the bore holes or mating bore holes has a second maximum radial gap and a second maximum tangential gap relative to the mechanical fastener extending through the second one of the bore holes or mating bore holes, and wherein the second maximum radial gap is greater than the first maximum radial gap or the second maximum tangential gap is greater than the first maximum tangential gap.

2. The turbomachine of claim 1, wherein the first maximum radial gap and the first maximum tangential gap are each less than or equal to 0.010 inches.

3. The turbomachine of claim 1, wherein the second maximum radial gap or the second maximum tangential gap is less than or equal to 0.200 inches.

4. The turbomachine of claim 1, wherein a third one of the bore holes or mating bore holes has a third maximum radial gap and a third maximum tangential gap relative to the mechanical fastener extending through the third one of the bore holes or mating bore holes, and wherein the third maximum radial gap is greater than the first maximum radial gap and the third maximum tangential gap is greater than the first maximum tangential gap.

5. The turbomachine of claim 4, wherein the third maximum radial gap and the third maximum tangential gap are less than or equal to 0.200 inches.

6. The turbomachine of claim 4, wherein the third one is a plurality of third ones.

7. The turbomachine of claim 1, wherein the plurality of bore holes or the plurality of mating bore holes includes only a single first one.

8. The turbomachine of claim 1, wherein the plurality of bore holes or the plurality of mating bore holes includes only a single second one.

9. The turbomachine of claim 1, wherein the first one is a first one of the plurality of bore holes and the second one is a second one of the plurality of bore holes.

10. The turbomachine of claim 1, wherein each of the plurality of mechanical fasteners comprises a bolt.

11. The turbomachine of claim 1, wherein the outlet of each of the plurality of transition ducts is further offset from the inlet along the radial axis.

12. The turbomachine of claim 1, further comprising a turbine section in communication with plurality of transition ducts, the turbine section comprising the support ring assembly and a first stage bucket assembly.

13. The turbomachine of claim 12, wherein no nozzles are disposed upstream of the first stage bucket assembly.

14. A turbomachine comprising:

a plurality of transition ducts disposed in a generally annular array and comprising a first transition duct and a second transition duct, each of the plurality of transition ducts comprising an upstream portion including an inlet and an aft end opposite the inlet a downstream portion including an outlet and a head end opposite the outlet, and a passage defining an interior and extending between the inlet and the outlet and defining a longitudinal axis, a radial axis, and a tangential axis, the outlet of each of the plurality of transition ducts offset from the inlet along the longitudinal axis and the tangential axis, the outlet of at least one transition duct of the plurality of transition ducts comprising an inner flange and an outer flange, wherein a plurality of bore holes are defined in the inner flange and the outer flange of the outlet of the at least one transition duct; and wherein an unbolted joint is defined between the aft end of the upstream portion and the head end of the downstream portion of each transition duct of the plurality of transition ducts, the unbolted joint being configured to permit movement between the upstream portion and the downstream portion along the longitudinal axis, the radial axis, and the tangential axis;

a support ring assembly downstream of the plurality of transition ducts along a hot gas path, wherein a plurality of mating bore holes are defined in the support ring assembly, and a plurality of mechanical fasteners connecting the inner flange and the outer flange of the at least one transition duct to the support ring assembly, each of the plurality of mechanical fasteners extending through a bore hole and mating bore hole;

wherein a single first one of the bore holes or mating bore holes has a first maximum radial gap and a first maximum tangential gap relative to the mechanical fastener extending through the first one of the bore holes or mating bore holes, wherein a second one of the bore holes or mating bore holes has a second maximum radial gap and a second maximum tangential gap relative to the mechanical fastener extending through the second one of the bore holes or mating bore holes, and wherein the second maximum radial gap is greater than the first maximum radial gap or the second maximum tangential gap is greater than the first maximum tangential gap, and wherein a plurality of third ones of the bore holes or mating bore holes each have a third maximum radial gap and a third maximum tangential gap relative to the mechanical fastener extending through the third ones of the bore holes or mating bore holes, and wherein each third maximum radial gap is greater than the first maximum radial gap and each third maximum tangential gap is greater than the first maximum tangential gap.

15. The turbomachine of claim 14, wherein the first maximum radial gap and the first maximum tangential gap are each less than or equal to 0.010 inches.

16. The turbomachine of claim 14, wherein the second maximum radial gap or the second maximum tangential gap is less than or equal to 0.200 inches, and wherein each of the plurality of third maximum radial gaps and third maximum tangential gaps is less than or equal to 0.200 inches.

17. The turbomachine of claim 14, wherein the plurality of bore holes or the plurality of mating bore holes includes only a single second one.

* * * * *